US007913884B2

(12) United States Patent
Kennedy

(10) Patent No.: US 7,913,884 B2
(45) Date of Patent: Mar. 29, 2011

(54) METHODS AND APPARATUS FOR PROCESSING MOLTEN MATERIALS

(75) Inventor: Richard L. Kennedy, Monroe, NC (US)

(73) Assignee: ATI Properties, Inc., Albany, OR (US)

( * ) Notice: Subject to any disclaimer, the term of this patent is extended or adjusted under 35 U.S.C. 154(b) by 936 days.

(21) Appl. No.: 11/218,008

(22) Filed: Sep. 1, 2005

(65) Prior Publication Data

US 2007/0057416 A1 Mar. 15, 2007

(51) Int. Cl.
*B22D 41/50* (2006.01)
*B22D 41/62* (2006.01)
*B22D 41/00* (2006.01)

(52) U.S. Cl. ..... 222/592; 222/591; 222/593; 266/202; 266/236; 266/241

(58) Field of Classification Search ..... 222/591, 222/592, 293; 266/202, 236, 241
See application file for complete search history.

(56) References Cited

U.S. PATENT DOCUMENTS

| | | | | |
|---|---|---|---|---|
| 1,545,253 | A | | 7/1925 | Hall |
| 2,997,245 | A | | 8/1961 | Nilsson et al. |
| 3,435,992 | A | * | 4/1969 | Tisdale et al. ..... 222/593 |
| 3,604,598 | A | * | 9/1971 | Kappmeyer et al. ..... 222/146.5 |
| 3,942,293 | A | * | 3/1976 | Cook ..... 52/232 |
| 3,988,084 | A | | 10/1976 | Esposito et al. |
| 4,485,834 | A | | 12/1984 | Grant |
| 4,619,845 | A | | 10/1986 | Ayers et al. |
| 4,631,013 | A | | 12/1986 | Miller |
| 4,784,302 | A | * | 11/1988 | Raman et al. ..... 222/603 |
| 4,801,412 | A | | 1/1989 | Miller |
| 4,946,082 | A | | 8/1990 | Brun et al. |
| 4,966,201 | A | | 10/1990 | Svec et al. |
| 4,978,039 | A | | 12/1990 | Brun et al. |
| 4,993,607 | A | | 2/1991 | Brun et al. |

(Continued)

FOREIGN PATENT DOCUMENTS

GB 2 154 902 A 9/1985

(Continued)

OTHER PUBLICATIONS

John Keith Beddow, "Atomizing Nozzles: Their Design and Use,"*The Production of Metal Powders by Atomization*, Chapter 4, Heyden & Son Ltd, 1978, pp. 44-47.

(Continued)

*Primary Examiner* — Roy King
*Assistant Examiner* — Lois Zheng
(74) *Attorney, Agent, or Firm* — K & L Gates LLP; Patrick J. Viccaro; John E. Grosselin, III

(57) ABSTRACT

Various non-limiting embodiments disclosed herein relate to nozzle assemblies for conveying molten material, the nozzle assemblies comprising a body, which may be formed from a material having a melting temperature greater than the melting temperature of the molten material to be conveyed, and having a molten material passageway extending therethrough. The molten material passageway comprises an interior surface and a protective layer is adjacent at least a portion of the interior surface of the passageway. The protective layer may comprise a material that is essentially non-reactive with the molten material to be conveyed. Further, the nozzle assemblies according to various non-limiting embodiments disclosed herein may be heated, and may be self-inspecting. Methods and apparatus for conveying molten materials and/or atomizing molten materials using the nozzle assemblies disclosed herein are also provided.

36 Claims, 7 Drawing Sheets

U.S. PATENT DOCUMENTS

| | | | | |
|---|---|---|---|---|
| 4,999,051 | A | | 3/1991 | Yolton et al. |
| 5,004,629 | A | | 4/1991 | Svec et al. |
| 5,011,049 | A | | 4/1991 | Borom et al. |
| 5,022,150 | A | | 6/1991 | Brun et al. |
| 5,048,732 | A | | 9/1991 | Borom et al. |
| 5,100,035 | A | | 3/1992 | Dunworth et al. |
| 5,125,574 | A | | 6/1992 | Anderson et al. |
| 5,164,097 | A | * | 11/1992 | Wang et al. ..... 222/590 |
| 5,176,874 | A | | 1/1993 | Mourer et al. |
| 5,272,718 | A | | 12/1993 | Stenzel et al. |
| 5,310,165 | A | | 5/1994 | Benz et al. |
| 5,346,184 | A | | 9/1994 | Ghosh |
| 5,346,530 | A | | 9/1994 | Miller et al. |
| 5,468,133 | A | | 11/1995 | Miller et al. |
| 5,480,470 | A | | 1/1996 | Miller et al. |
| 5,516,354 | A | | 5/1996 | Miller et al. |
| 5,520,371 | A | | 5/1996 | Miller et al. |
| 5,529,292 | A | | 6/1996 | Accary et al. |
| 5,589,199 | A | | 12/1996 | Anderson et al. |
| 5,595,765 | A | | 1/1997 | Christensen et al. |
| 5,601,781 | A | | 2/1997 | Miller et al. |
| 5,656,061 | A | | 8/1997 | Miller et al. |
| 5,744,050 | A | | 4/1998 | Shaw |
| 5,934,900 | A | | 8/1999 | Billings |
| 5,985,206 | A | | 11/1999 | Zabala et al. |
| 6,142,382 | A | | 11/2000 | Ting et al. |
| 6,234,783 | B1 | | 5/2001 | Shibata et al. |
| 6,358,466 | B1 | * | 3/2002 | Besser et al. ..... 266/234 |

FOREIGN PATENT DOCUMENTS

| | | | |
|---|---|---|---|
| JP | 62-224472 | * | 10/1987 |

OTHER PUBLICATIONS

Shinohara Yoshiyuki, "Nozzle for Gas Atomization of Molten Metal," Patent Abstracts of Japan, Publication No. 05-202404, Publication Date Aug. 10, 1993.

* cited by examiner

METHODS AND APPARATUS FOR PROCESSING MOLTEN MATERIALS

BACKGROUND

Methods and apparatus for processing molten materials, and more particularly, methods and apparatus for conveying and/or atomizing molten materials using a nozzle are disclosed herein.

Critical powder metal components, such as turbine rotor disks, that are manufactured from nickel-base alloy powders must be manufactured using specialized processing and handling techniques to assure that the components are free from extremely small defects. This is because defects on the order of a few square thousandths of an inch can cause catastrophic failure of the components. As discussed below, one source of such defects in components manufactured from powders of nickel-base alloys is the ceramic nozzle commonly employed during manufacture of the powders to control the size of the molten metal stream and to direct it into the atomizing field.

More specifically, during atomization, molten metal is flowed from a vessel (for example a melting or refining furnace) through a nozzle to create a steam. On exiting the nozzle, the stream of molten metal is impinged with a fluid stream, which may be a liquid or a gas stream, to break-up or atomize the molten metal into droplets. The molten metal droplets cool to form powders as they fall from the atomization zone into a collection chamber. Because of the very high temperatures required to melt these superalloys, ceramic or refractory-lined nozzles have been used in the atomization process. One example of a ceramic nozzle is disclosed in British Patent No. GB 2154901 A and one example of a refractory-lined nozzle is disclosed in U.S. Pat. No. 1,545,253.

However, while ceramic and refractory-lined nozzles are advantageous in that they can withstand high processing temperatures, it has been found that the reactivity of many molten metals (such as nickel-base or titanium-base alloys) and the rapid flow of molten metal through the nozzle can cause erosion or degradation of the ceramic or refractory-lining. As the ceramic erodes, particles (i.e., erosion debris) are entrained in the molten metal stream. If the particles are too large to pass through the nozzle, the nozzle will become clogged, thereby stopping production. On the other hand, if the particles are small enough to pass through the nozzle, the particles will be incorporated into the metal powders or will be collected with the metal powders in the collection chamber. The presence of these particles in the atomized metal powder, either as inclusions in the metal powder or as separate particulate matter, is deleterious to the quality of the metal powders. For example, because ceramic inclusions can act as stress-concentrations sites, metal components formed from powders containing ceramic particles (either as inclusions in the powder or as separate particulate matter) can fail prematurely. Although it is possible to remove ceramic particles larger than some critical size by screening, this both increases the cost of the powders and creates scrap.

One alternative to ceramic nozzles that has been investigated is water-cooled copper nozzles having an induction heating coil positioned around the perimeter of the nozzle to inductively heat the molten metal flowing through the nozzle. One example of such a nozzle is disclosed in U.S. Pat. No. 5,272,718. However, because copper has a melting temperature significantly lower than the melting temperature of the alloys being processed, the copper nozzle itself cannot be heated to a high enough temperature to prevent solidification of the molten metal in the nozzle. Instead, the molten metal flowing through the nozzle must be inductively heated to prevent solidification. Further, the copper nozzle must be water-cooled to prevent the nozzle from melting or deforming during processing, and to allow a layer of solidified metal to form on the surface of the nozzle to prevent copper from the nozzle from dissolving in the molten metal. Since water-cooled, copper nozzles generally require frequent replacement and high power for operation, they can be costly to operate. Moreover, freeze-up of the nozzles due to solidification of molten metal either in the nozzle passageway or at the point of egress of the molten metal from the nozzle can be a frequent cause of process downtime.

Accordingly, there is a need for a nozzle that is compatible for use with high-temperature molten metals, such as nickel-base or titanium-base alloys. More particularly, there is a need for a nozzle that can withstand the high temperatures and environmental conditions associated with the atomization of nickel-base or titanium-base alloys, that can be directly heated to prevent freeze-up during processing, that can be readily monitored such that if the nozzle does fail the process can be stopped prior to forming a substantial quantity of metal powder that must be scrapped, and that can be rapidly cooled to permit the process to be quickly stopped if necessary or desired.

BRIEF SUMMARY OF THE DISCLOSURE

Aspects of the present invention relate to nozzle assemblies for conveying molten material. For example, one non-limiting embodiment provides a nozzle assembly for conveying a molten material, the nozzle assembly comprising a body comprising a first surface, a second portion opposite the first surface, and a molten material passageway extending through the body from the first surface to the second portion to permit the flow of molten material through the body, the molten material passageway having an interior surface; and a protective layer adjacent at least a portion of the first surface of the body and at least a portion of the interior surface of the molten material passageway, the protective layer having a thickness ranging from 0.001 millimeter to 1 millimeter.

Another non-limiting embodiment provides a nozzle assembly for conveying a molten material, the nozzle assembly comprising a body formed from a material having a melting temperature greater than a melting temperature of the molten material to be conveyed by the nozzle assembly, the body comprising a first surface, a second portion opposite the first surface, and a molten material passageway extending through the body from the first surface to the second portion to permit the flow of molten material through the body, the molten material passageway having an interior surface; and a protective layer adjacent at least a portion of the first surface of the body and at least a portion of the interior surface of the molten material passageway, the protective layer comprising a material that is essentially non-reactive with the molten material to be conveyed by the nozzle assembly.

Still another non-limiting embodiment provides a nozzle assembly for conveying a molten material, the nozzle assembly comprising a body formed from a material having a melting temperature greater than a melting temperature of the molten material to be conveyed by the nozzle assembly, the body comprising a first surface, a second surface opposite the first surface, a sidewall extending between a periphery of the first surface and a periphery of the second surface, and a molten material passageway extending through the body from the first surface to the second surface to permit the flow of molten material through the body, the molten material passageway having an interior surface; a base adapted to receive the body, the base comprising a support surface, wherein at least a portion of the support surface of the base is adjacent at least a portion of the sidewall of the body; and a protective layer adjacent at least a portion of the first surface of the body and at least a portion of the interior surface of the molten material passageway, the protective layer having a thickness ranging from 0.001 millimeter to 1 millimeter and comprising a material that is essentially non-reactive with the molten material to be conveyed by the nozzle assembly.

Another non-limiting embodiment provides a nozzle assembly for conveying a molten material, the nozzle assembly comprising a body comprising a material having a melting temperature greater than a melting temperature of the molten material conveyed by the nozzle assembly, the body comprising a first surface; means for permitting flow of molten material through the body; and means for preventing at least a portion of the material of the body from contacting at least a portion of the molten material conveyed by the nozzle assembly.

Yet another non-limiting embodiment provides a nozzle assembly for conveying a molten material, the nozzle assembly comprising a body formed from molybdenum or a molybdenum alloy, the body comprising a first surface, a second surface opposite the first surface, a sidewall extending between and connecting a periphery of the first surface and a periphery of the second surface, and a molten material passageway extending through the body from the first surface to the second surface to permit the flow of molten material through the body, the molten material passageway having an interior surface; a protective layer adjacent at least a portion of the first surface of the body and at least a portion of the interior surface of the molten material passageway, the protective layer comprising aluminum oxide; a split-base comprising a support surface, the support surface being adjacent the sidewall of the body, the split-base including a first component and a second component that together are adapted to receive the body; and means for heating the nozzle assembly connected to the split-base.

Other aspects of the present invention relate to methods of manufacturing nozzle assemblies. For example, one non-limiting embodiment provides a method of manufacturing a nozzle assembly for conveying a molten material, the method comprising providing a body comprising a material having a melting temperature greater than the temperature of the molten material to be conveyed by the nozzle assembly, the body comprising a first surface, a second portion opposite the first surface, and a molten material passageway extending through the body from the first surface to the second portion to permit the flow of molten material through the body, the molten material passageway having an interior surface; and forming a protective layer on at least a portion of the first surface of the body and on at least a portion of the interior surface of the molten material passageway, the protective layer comprising a material that is essentially non-reactive with the molten material to be conveyed by the nozzle assembly.

Yet other aspects of the present invention relate to apparatus for atomizing molten material. For example, one non-limiting embodiment provides an apparatus for atomizing a molten material, the apparatus comprising a vessel for molten material, the vessel including a channel permitting a flow of the molten material from the vessel; a nozzle assembly adjacent the vessel to receive the flow of the molten material from the channel of the vessel, the nozzle assembly comprising a body formed from a material having a melting temperature greater than a melting temperature of the molten material, the body comprising a first surface, a second portion opposite the first surface, and a molten material passageway extending through the body from the first surface to the second portion to permit the flow of molten material through the body, the molten material passageway having an interior surface; and a protective layer on at least a portion of the first surface of the body and on at least a portion of the interior surface of the molten material passageway, the protective layer comprising a material that is essentially non-reactive with the molten material to be conveyed by the nozzle assembly; and an atomizer in fluid communication with the nozzle assembly.

Another non-limiting embodiment provides an apparatus for atomizing molten material, the apparatus comprising means for supplying a molten material; means for receiving molten material from the supply means in fluid communication with the supply means, the means for receiving molten material comprising a body formed from a material having a melting temperature greater than a temperature of the molten material, the body comprising a first surface, a second portion opposite the first surface, means for permitting a flow of molten material through the body, and means for preventing at least a portion of the material of the body from contacting at least a portion of the molten material conveyed by the nozzle assembly; and means for atomizing molten material in fluid communication with at least a portion of the means for receiving molten material.

Other aspects of the present invention relate to methods for conveying and/or atomizing molten materials. For example, one non-limiting embodiment provides a method of conveying a molten material, the method comprising providing a molten material in a vessel, the vessel including a channel permitting a flow of molten material from the vessel; flowing at least a portion of the molten material from the vessel through the channel and into a nozzle assembly adjacent the vessel, the nozzle assembly comprising a body formed from a material having a melting temperature greater than a melting temperature of the molten material, the body comprising a first surface, a second portion opposite the first surface, and a molten material passageway extending through the body from the first surface to the second portion to permit the flow of molten material through the body, the molten material passageway having an interior surface; and a protective layer on at least a portion of the first surface of the body and on at least a portion of the interior surface of the molten material passageway, the protective layer comprising a material that is essentially non-reactive with the molten material to be conveyed by the nozzle assembly; flowing at least a portion of the molten material through the molten material passageway of the body of the nozzle assembly; and forming a molten material exit stream from at least a potion of the molten material flowing through the molten material passageway of the body of the nozzle assembly. Further, according to this non-limiting embodiment, the method can comprise atomizing at least a portion of the molten material exit stream by impinging a portion of the molten material exit stream with a fluid stream

BRIEF DESCRIPTION OF THE DRAWINGS

Various non-limiting embodiments of the present invention may be better understood when read in conjunction with the drawings, in which.

DETAILED DESCRIPTION OF VARIOUS NONLIMITING EMBODIMENTS OF THE INVENTION

Various non-limiting embodiments disclosed herein provide methods and apparatus for conveying and/or atomizing molten materials, and in particular, high temperature, reactive molten metals. For example, certain non-limiting embodiments disclosed herein relate to nozzle assemblies and apparatus for conveying or atomizing molten materials, such as nickel-base and titanium-base alloys. Other non-limiting embodiments relate to methods of manufacturing nozzles assemblies for conveying molten materials. Still other non-limiting embodiments relate to methods of conveying molten materials and methods of atomizing molten materials.

Figure 1:
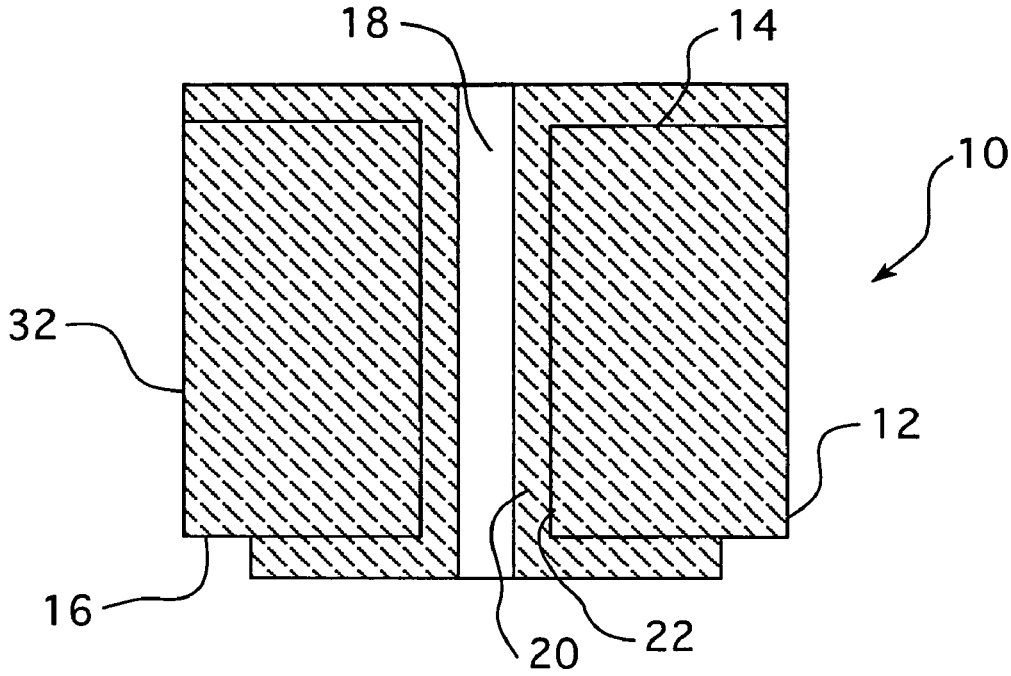
FIGS. 1-5, and 9 are schematic cross-sectional views of nozzle assemblies according to various non-limiting embodiments of the present invention.
Figure 3:
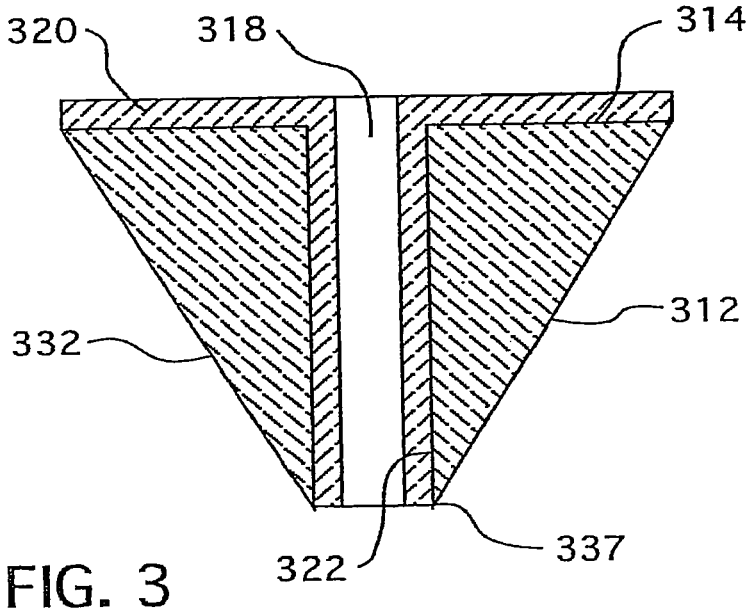

With reference to the figures, wherein like numerals indicate like features throughout, there is shown in FIG. 1 a nozzle assembly for conveying a molten material, generally indicated as 10, according to one non-limiting embodiment disclosed herein. The nozzle assembly comprises a body 12 comprising a first surface 14 and a second portion 16, which may be a surface as shown in FIG. 1 or an edge as shown in FIG. 3, opposite first surface 14. Body 12 may be formed from any material having a melting temperature greater than the melting temperature of the molten material conveyed by the nozzle assembly. For example, although not limiting herein, when the molten material being processed is titanium, body 12 may be formed from a material having melting temperature greater than the melting temperature of titanium, which is about 1660° C. Non-limiting examples of materials that can be used to form body 12 are listed in Table 1 below, together with their melting temperatures and resistivity at room temperature.

TABLE 1

| Material | Melting Temperature (° C.) | Resistivity(Ω · m) at Room Temperature |
|---|---|---|
| Titanium | 1660* | $42.0 \times 10^{-8}$* |
| Zirconium | 1852* | $42.1 \times 10^{-8}$* |
| Hafnium | 2230* | $35.1 \times 10^{-8}$* |
| Vanadium | 1887* | $24.8 \times 10^{-8}$* |
| Niobium | 2468* | $12.5 \times 10^{-8}$* |
| Tantalum | 2996* | $12.45 \times 10^{-8}$* |
| Chromium | 1857* | $12.7 \times 10^{-8}$* |
| Molybdenum | 2617* | $5.2 \times 10^{-8}$* |
| Tungsten | 3407* | $5.65 \times 10^{-8}$* |
| Platinum | 1772* | $10.6 \times 10^{-8}$* |
| Graphite | — | $1.375 \times 10^{-5}$* |
| molybdenum disilicide | — | $37 \times 10^{-8}$** |
| silicon carbide | 2300-2500*** | $99.5\text{-}199.5 \times 10^{-8}$** |
| nickel aluminide | 1638**** | — |

*John Emsley, The Elements, 2nd Ed., Claredon Press, Oxford (1991), pp. 46, 52, 82, 118, 128, 142, 184, 200, 202, 210, 220.
**ASM Metals Handbook, Desk Ed., ASM International, Warrenville, OH (1998) p. 655.
***William Callister, Jr. Materials Science and Engineering: An Introduction, 2nd Ed., John Wiley & Sons, Inc., New York (1991) p. 740.
****Phil Hansen, Constitution of Binary Alloys, McGraw-Hill (1958) p.119.

According to various non-limiting embodiments disclosed herein, the body may be formed from a material selected from, for example, the group consisting of titanium and titanium alloys, zirconium and zirconium alloys, hafnium and hafnium alloys, vanadium and vanadium alloys, niobium and niobium alloys, tantalum and tantalum alloys, chromium and chromium alloys, molybdenum and molybdenum alloys, tungsten and tungsten alloys, platinum and platinum alloys, graphite, molybdenum disilicide, silicon carbide, nickel aluminide and combinations and mixtures thereof. For example, in one non-limiting embodiment, the body may be formed molybdenum, a molybdenum alloy, tungsten, or graphite. In another non-limiting embodiment the body may be formed from molybdenum or a molybdenum alloy.

Although not required, according to certain non-limiting embodiments disclosed herein, in order to further reduce or prevent softening and deformation of the nozzle assembly during processing, body 12 can be formed from a material having a melting temperature that is at least 250° C. greater than the melting temperature of the molten material to be conveyed by the nozzle assembly. However, from the perspective of softening and deformation of the nozzle assembly, the greater the melting temperature of the material used to form body 12 is above the melting temperature of the material being conveyed, the less softening and deformation of the body is likely to occur. Accordingly, various non-limiting embodiments of the present invention contemplate forming body 12 from a material having a melting temperature at least 400° C. greater than the temperature of the molten material being conveyed by the nozzle assembly.

According to various non-limiting embodiments disclosed herein, body 12 may be directly heated in order to facilitate the flow of molten material through the body, the use of small diameter nozzles, and to prevent freeze-up of the nozzle assembly. According to these non-limiting embodiments, in addition to having a melting temperature greater than the material being conveyed by the nozzle assembly, the material from which body 12 is formed may have an electrical resistivity at room temperature ranging from about $1\times10^{-8}$ Ohms·meters ("Ω·m") to about $1\times10^{-5}$ Ω·m to facilitate direct resistance or induction heating of body 12. The electrical resistivities at room temperature for several non-limiting examples of materials from which body 12 may be formed according to these non-limiting embodiments are listed above in Table 1. In one particular non-limiting embodiment wherein the body is heated by direct resistance heating (as described in more detail below), the body may be formed from molybdenum, a molybdenum alloy, tungsten, or graphite.

Referring again to FIG. 1, body 12 comprises a molten material passageway 18 that extends through body 12 from first surface 14 to second portion 16 to permit the flow of molten material through body 12, and has an interior surface 22. Molten material passageway 18 can have any configuration desired to achieve optimal processing characteristics. For example, according to various non-limiting embodiments, the molten material passageway may have a circular cross-section. According to other non-limiting embodiments, the molten material passageway may have a non-circular cross-section, for example, an elliptical configuration. Further, although not shown in the figures, according to various non-limiting embodiments disclosed herein, the body of the nozzle assembly can comprise two or more molten material passageways extending therethrough.

Figure 2:
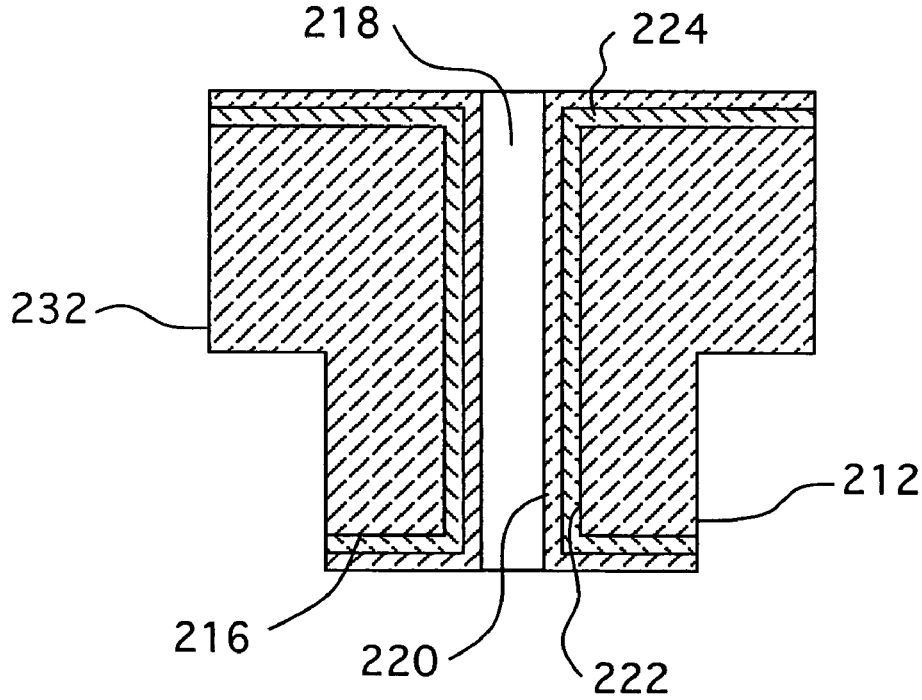

Referring again to FIG. 1, protective layer 20 is adjacent at least a portion of interior surface 22 of passageway 18, and optionally can be adjacent at least a portion of first surface 14 of body 12 to reduce or prevent contact between body 12 and the molten material being conveyed. Although not required, as shown in FIG. 1, protective layer 20 can be on the entire first surface 14 of body 12. Further, as shown in FIG. 1, according to certain non-limiting embodiments disclosed herein, protective layer 20 may also be adjacent at least a portion of the second portion 16. Alternatively, as shown in FIG. 2, protective layer 220 can be on the entire second surface 216.

As used herein the term "layer" means a generally continuous film, coating or deposit. Further, the term "layer" includes generally continuous films, coatings or deposits that have a uniform composition and/or thickness, as well as generally continuous films, coatings or deposits that do not have a uniform composition and/or thickness. For example, according to certain non-limiting embodiments, the thickness and/or composition of the protective layer can vary from one region to another within the protective layer, provided that the protective layer forms an adequate barrier between the material forming the nozzle body and the molten material being conveyed by the nozzle.

The protective layer according to various non-limiting embodiments disclosed herein can be formed from any material that is essentially non-reactive with the molten material conveyed by the nozzle assembly. As used herein with respect to the protective layer, the phrase "essentially non-reactive with the molten material" means the material forming the protective layer is either non-reactive with the molten material or has a limited reactivity with the molten material such that the protective layer is not substantially degraded due to reaction with the molten material during operation of the nozzle. Examples of materials suitable for use in forming the protective layer include, but are not limited to oxides. Suitable oxides include, without limitation, aluminum oxide, zirconium oxide, magnesium oxide, calcium oxide, hafnium oxide, yttrium oxide, lanthanum oxide, calcium oxide, and combinations and mixtures thereof. For example, in one non-limiting embodiment, the protective layer may be formed from zirconium oxide that is at least partially stabilized in the cubic crystal structure at room temperature. According to another non-limiting embodiment, the protective layer may be formed from aluminum oxide.

Referring again to FIG. 1, as discussed above, protective layer 20 can reduce or prevent contact between at least a portion of the material forming body 12 and the molten material conveyed by the nozzle assembly. However, as previously discussed with respect to ceramic nozzles, the rapid flow of molten material through the nozzle may cause erosion. In order to reduce or prevent issues related to the unrecognized entrainment of erosion debris from protective layer 20 in the molten material conveyed by the nozzle assembly, in certain non-limiting embodiments of the present invention, the thickness of protective layer 20 is no greater than 1 millimeter (mm), and may be no greater than 0.5 mm. For example, according to one non-limiting embodiment, the thickness of the protective layer can range from about 0.001 mm to about 1 mm. In another non-limiting embodiment, the thickness of the protective layer can range from 0.01 mm to 0.25 mm.

Further, as discussed below in more detail, the nozzle assemblies according to various non-limiting embodiments disclosed herein are "self-inspecting." More particularly, if a portion of the protective layer is removed during operation, for example due to erosion, spalling, or other mechanical failure, the molten material conveyed by the nozzle assembly can come into direct contact with a portion of the body, resulting in dissolution of material from that portion of the body. Dissolution of material from the body can be quickly detected by a change in the appearance and/or flow rate of the molten material exit stream. Additionally, since the nozzle assemblies according to various non-limiting embodiments disclosed herein can be directly heated (e.g., by resistance or induction heating), if failure of the body is detected, the process can be quickly stopped by lowering or turning off the power to the nozzle to rapidly decrease the nozzle temperature and solidify the molten material in the passageway. Since the solidification of molten material in the passageway will prevent further flow, production can be stopped before large quantities of scrap material are generated.

As discussed above, according to various non-limiting embodiments disclosed herein, the body of the nozzle assembly may be directly heated, for example, by direct resistance heating. According to these non-limiting embodiments, the protective layer can be formed from a material that is essentially non-reactive with the molten material and electrically insulating to prevent electrical shorting or losses through the molten material being conveyed and/or other components of the nozzle assembly or atomization apparatus. Examples of materials that may be used to form the protective layer according to these non-limiting embodiments include, but are not limited to, oxides selected from the group consisting of aluminum oxide, zirconium oxide, magnesium oxide, calcium oxide, hafnium oxide, yttrium oxide, and mixtures and combinations thereof.

According to various non-limiting embodiments disclosed herein, one or more intermediate layers may be positioned between the protective layer and the interior surface of the passageway of the body. Although not required, according to these non-limiting embodiments, each of the intermediate layers may be formed from a material having a coefficient of thermal expansion that is intermediate between that of the body material and the protective layer to facilitate thermal expansion matching of the body and the protective layer.

For example and with reference to FIG. 2, according to various non-limiting embodiments, an intermediate layer 224 can be interposed between the interior surface 222 of passageway 218 and protective layer 220. According to these non-limiting embodiments, intermediate layer 224 may have a coefficient of thermal expansion between the coefficient of thermal expansion of body 212 and the coefficient of thermal expansion of protective layer 220. Although not limiting herein, it is contemplated that if the intermediate layer has a coefficient of thermal expansion between that of the body and that of the protective layer, the likelihood of the protective layer cracking or spalling due to differential thermal expansion of the protective layer and the body can be reduced or eliminated. As previously discussed, because the protective layer is in contact with the molten material conveyed through the passageway of the body during use, the protective layer is formed from a material that is essentially non-reactive with the molten material as previously discussed. However, since the intermediate layer is not in direct contact with the molten material, the intermediate layer need not, but may, be formed from a material that is essentially non-reactive with the molten material.

Referring back to FIG. 1, body 12 further includes a sidewall 32 that extends between and connects the periphery of first surface 14 and the periphery of second portion 16. Sidewall 32 can have any contour necessary for compatibility with other processing equipment. For example, although not limiting herein, sidewall 32 can be a straight sidewall, as shown in FIG. 1; a stepped sidewall 232, as shown in FIG. 2; or a tapered sidewall 332, as shown in FIG. 3. Alternatively, although not shown in the figures, the sidewall can be threaded or otherwise adapted to mate with other equipment as required.

Referring now to FIG. 3, according to another non-limiting embodiment, body 312 can include first surface 314 and second portion 337 opposite first surface 314. As shown in FIG. 3, second portion 337 is an edge. According to this non-limiting embodiment, sidewall 332 extends between and connects at least a portion of first surface 314 and second portion 337, and molten material passageway 318 extends between first surface 314 and second portion 337. Further, as shown in FIG. 3, a protective layer 320 is adjacent first surface 314 and interior surface 322 of passageway 318.

Figure 4:
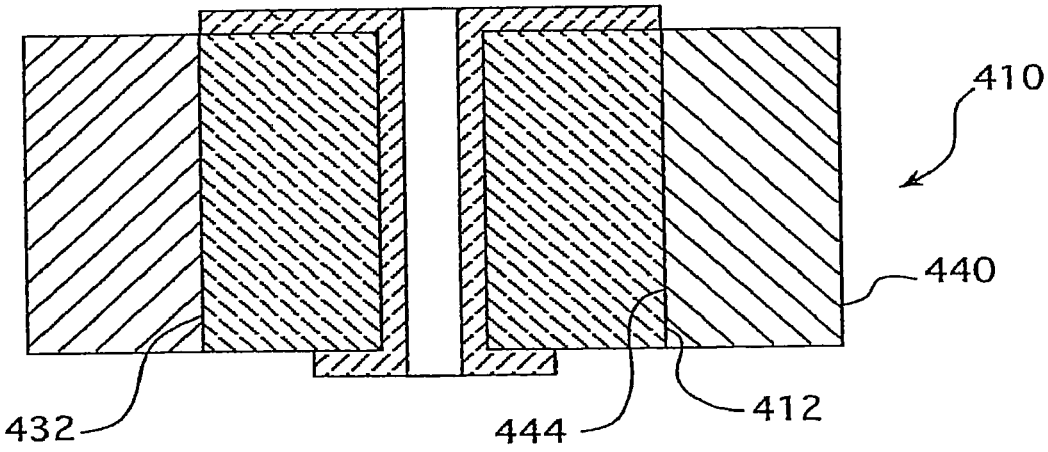
Figure 5:
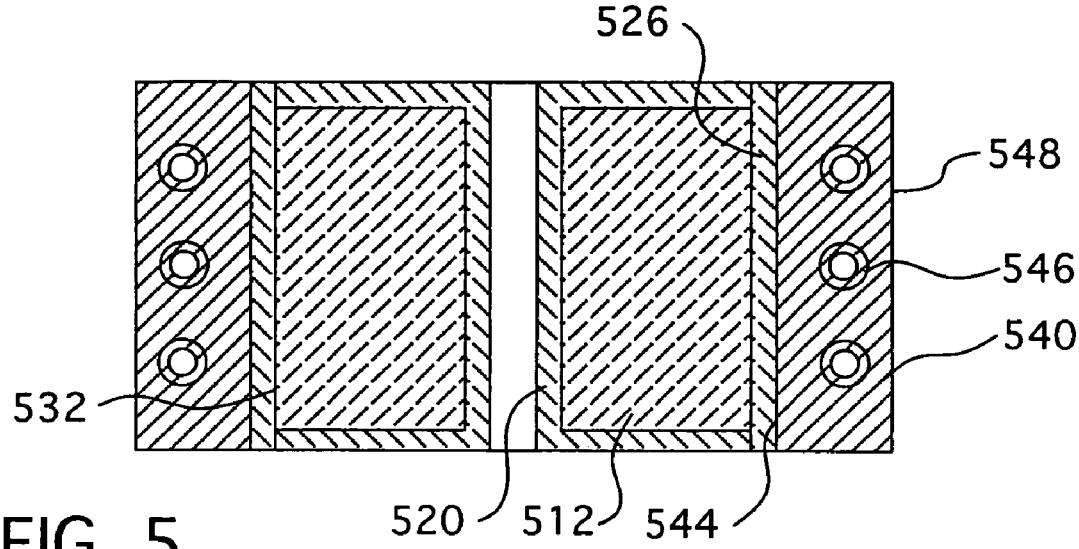

Referring now to FIG. 4, according to various non-limiting embodiments disclosed herein, the nozzle assembly, generally designated 410, may further comprise a base 440, which is adapted to receive body 412. Base 440 includes a support surface 444. As shown in FIG. 4, support surface 444 of base 440 is adjacent at least a portion of sidewall 432 body 412. Further, as shown in FIG. 4, according to various non-limiting embodiments, support surface 444 may be in direct contact with at least a portion of sidewall 432. Alternatively, as shown in FIG. 5, according to other non-limiting embodiments, a layer 526 can be interposed between at least a portion of support surface 544 of base 540 and at least a portion of sidewall 532 of body 512. Although not required, layer 526 can be formed from the same material as protective layer 520, or it can be formed from a different material. Further, layer 526 and can have the same thickness as protective layer 520 or it can have a different thickness as required.

Referring again to FIG. 5, base 540 includes an exterior surface 548. Exterior surface 548 can have any contour required for compatibility with other processing equipment. For example, although not limiting herein, as shown in FIG. 5, exterior surface 548 can have a straight contour. Alternatively, although not shown in the figures, as discussed above with reference to the sidewall of the body, exterior surface 548 of base 540 can be tapered, stepped, threaded, etc., as required for compatibility with other processing equipment. Further, according to certain embodiments disclosed herein, base 540 may be formed from a thermally conductive material. Although not limiting herein, it is contemplated that by forming the base from a thermally conductive material, the base will be able to distribute heat, thereby facilitating uniformity in body temperature. Further, by cooling the base, for example by water-cooling, if necessary or desired, heat can be extracted from the body to prevent overheating during use. For example, as indicated in FIG. 5, base 540 can include one or more cooling channels 546 within base 540 through which a coolant (such as, but not limited to, water) can be circulated to cool base 540.

Non-limiting examples of materials from which the base of the nozzle assembly may be formed according to various non-limiting embodiments disclosed herein include copper and copper alloys, aluminum and aluminum alloys, graphite, and tungsten. According to one non-limiting embodiment of the present invention, the base is formed from copper or a copper alloy.

As previously discussed, copper nozzles cannot be directly heated to a temperature that is high enough to prevent solidification of high temperature alloys in the nozzle during processing. Further, since conventional ceramic nozzles are electrically insulating, conventional ceramic nozzles cannot be directly resistance or induction heated. In contrast, the nozzle assemblies according to various non-limiting embodiments disclosed are capable of being directly heated, for example by resistance or induction heating. As previously discussed, by directly heating the nozzle, the flow of molten material through the nozzle can be quickly stopped when desired by reducing the nozzle temperature. Further, because the nozzle assemblies can be directly heated, small diameter passageways, which can permit matching of exit stream flow rates with other processing parameters (such as melt rates and atomization rates), may be employed.

Figure 6:
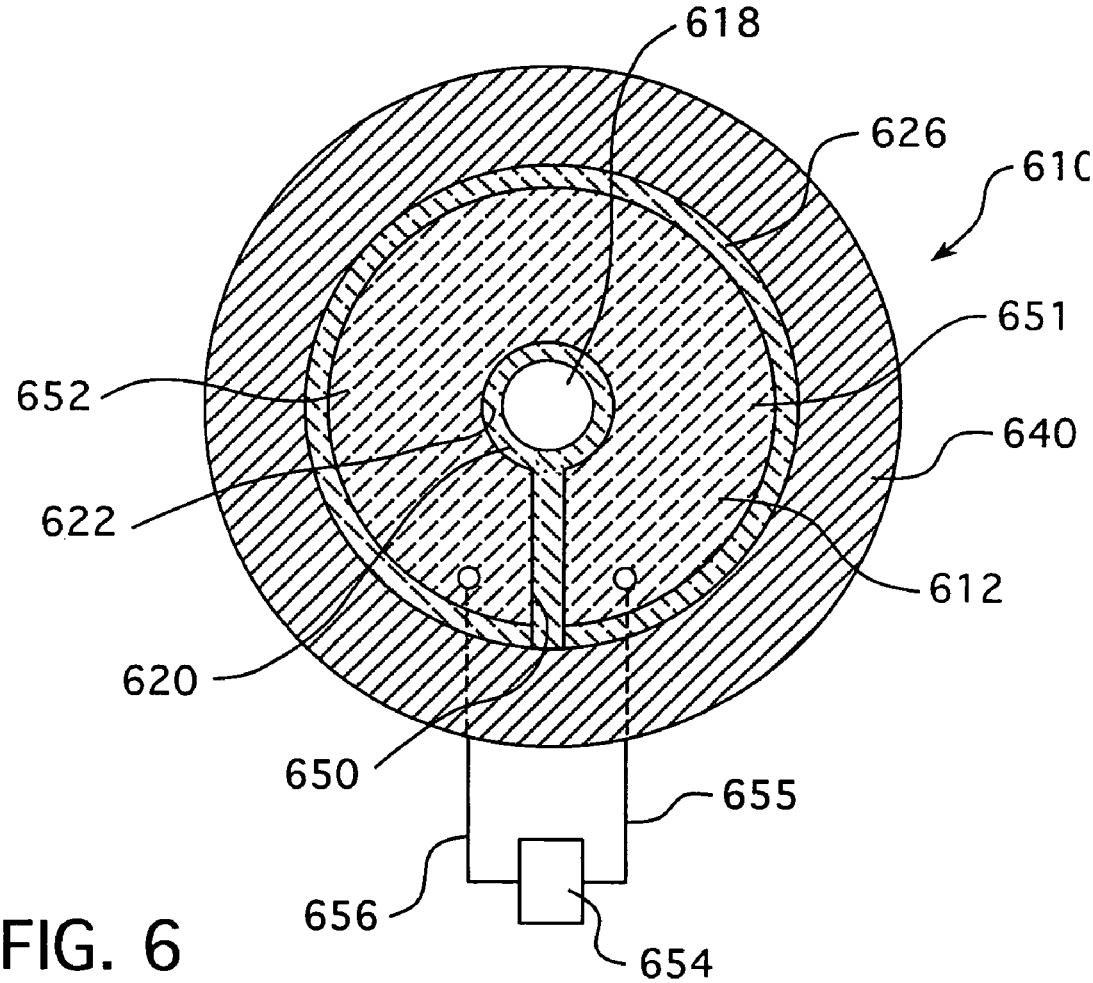
FIGS. 6-8 are schematic top cross-sectional views of nozzle assemblies according to various non-limiting embodiments of the present invention.
Figure 7:
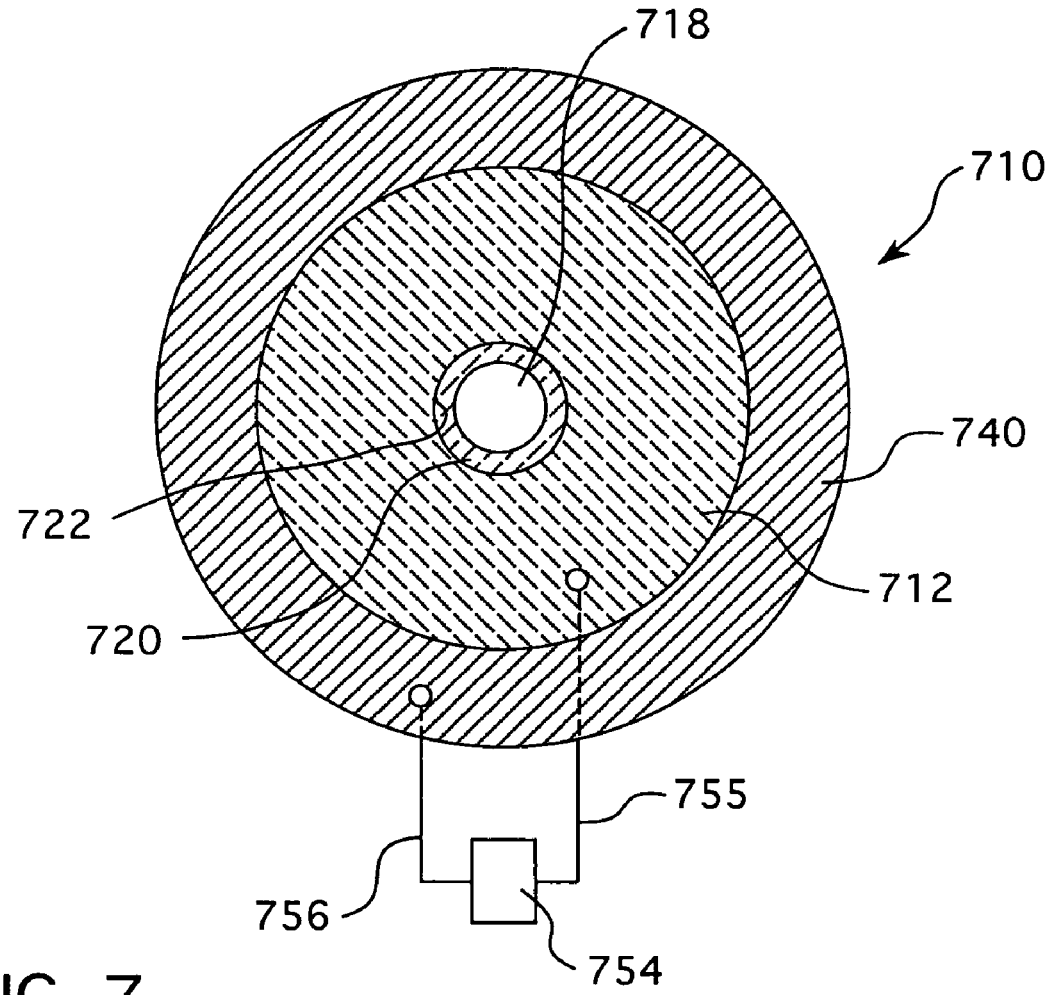
Figure 8:
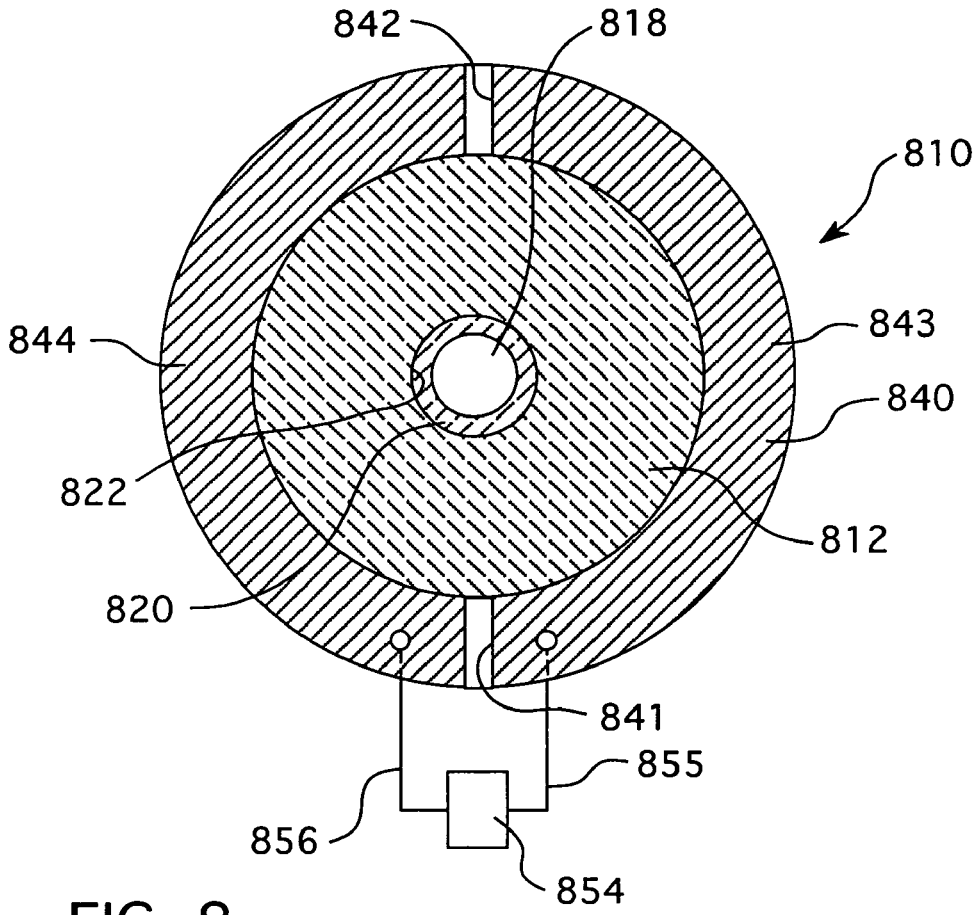

Referring now to FIGS. 6-8, as previously discussed, the nozzle assemblies according to various non-limiting embodiments disclosed herein can be directly heated in order to facilitate the flow of the molten material through the nozzle assembly and prevent freeze-up. For example, according to one non-limiting embodiment, the nozzle assembly can be heated as shown schematically in FIG. 6. More particularly, as shown in FIG. 6, the nozzle assembly, generally indicated as 610, comprises a body 612 and a base 640 adapted to receive body 612. Nozzle assembly 610 is heated by directly heating body 612. A slot 650 formed in body 612 separates body 612 into two interconnected regions (indicated in FIG. 6 as 651 and 652, respectively). As shown in FIG. 6, a power source 654 is connected to body 612 to permit the direct heating of body 612. A first terminal 655 of power source 654 is connected to first region 651 and a second terminal 656 of power source 654 is connected to second region 652 to form a circuit for heating body 612.

As previously discussed (and as indicated in FIG. 6) a protective layer 620 is adjacent interior surface 622 of passageway 618 to reduce or prevent contact between body 612 and the molten material conveyed by the nozzle assembly and to prevent electrical shorts or losses between body 612 and the molten material being conveyed. Optionally, as shown in FIG. 6, protective layer 620 may be positioned within at least a portion of slot 650 to prevent leakage of molten material and/or electrical shorts or losses as discussed above. Further, according to this non-limiting embodiment, protective layer 620 may be formed from a material that is both essentially non-reactive with the molten material and electrically insulating. Additionally, according to this non-limiting embodiment, a layer 626 can be interposed between body 612 and base 640. According to this non-limiting embodiment, layer 626 can be formed from an electrically insulating material to prevent electrical shorts between body 612 and base 640 during heating. Further, as previously discussed, layer 626 can comprise the same material as protective layer 620 and have the same thickness as protective layer 620, or alternatively, layer 626 can comprise a different material and/or have a different thickness than protective layer 620.

According to various non-limiting embodiments disclosed herein, and as shown in FIGS. 6 and 7, the base (640, 740 shown in FIGS. 6 and 7, respectively) can comprise a single component that is adapted to receive the body (612, 712). Alternatively, as shown in FIG. 8, the base (indicated as 840 in FIG. 8) can have a multi-component or split design. For example, as shown in FIG. 8, the base is a split-base comprising two components (specifically 843 and 844 as shown in FIG. 8) that together receive body 812.

Referring now to FIG. 7, there is shown another non-limiting embodiment of a nozzle assembly, generally indicated as 710. As shown in FIG. 7, nozzle assembly 710 comprises body 712 and base 740 adapted to receive body 712. A power source 754 is connected to nozzle assembly 710 to permit the direct heating of the nozzle assembly. More particularly, as shown in FIG. 7, a first terminal 755 of power source 754 is connected to at least a portion of body 712, and a second terminal 756 of power source 754 is connected to at least a portion of base 740. A protective layer 720 is on at least a portion of interior surface 722 of passageway 718 to prevent contact between body 712 and the molten material conveyed by the nozzle assembly. Further, although not shown in FIG. 7, a layer can be interposed between body 712 and base 740 (as described above with reference to FIGS. 5 and 6). According to this non-limiting embodiment, if a layer is interposed between body 712 and base 740, the layer should permit current to flow between body 712 and base 740.

Referring now to FIG. 8, there is shown another non-limiting embodiment of a nozzle assembly, generally indicated as 810. As shown in FIG. 8, nozzle assembly 810 comprises body 812 and base 840 adapted to receive body 812. As previously discussed, according to various non-limiting embodiments disclosed herein (and as shown in FIG. 8) the base 840 may comprise two (or more) components 843 and 844 that together are adapted to receive body 812. Although not shown in FIG. 8, an insulating material can be positioned between components 843 and 844 of base 840, for example, in regions 841 and/or 842. As shown in FIG. 8, a power source 854 may be connected to nozzle assembly 810 to permit the direct heating of the nozzle assembly. More particularly, as shown in FIG. 8, terminal 855 of power source 854 can be connected to component 843 of base 840, and terminal 856 of power source 854 can be connected to component 844 of base 840, to permit heating of nozzle assembly 810. A protective layer 820 is on at least a portion of the interior surface 822 of passageway 818 to prevent contact between body 812 and the molten material conveyed by the nozzle assembly.

Figure 9:
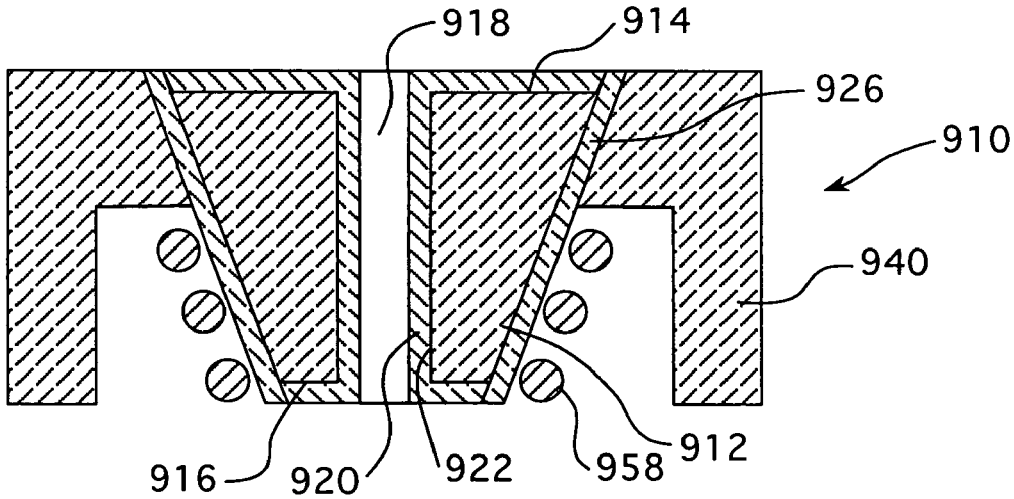

Other methods of heating the nozzle assemblies are contemplated by various embodiments of the present invention. For example, although not limiting herein, the nozzle assembly can be inductively or indirectly resistance heated. As shown in FIG. 9, the nozzle assembly, generally indicated as 910, can comprise body 912 and base 940 adapted to receive body 912. An induction or resistance heating coil 958 can be positioned around the perimeter of body 912 to permit indirect inductive or resistance heating of body 912. As shown in FIG. 9, protective layer 920 may be adjacent an interior surface 922 of passageway 918, first surface 914, and second surface 916 of body 912. Further, as shown in FIG. 9, a layer 926 can be interposed between at least a portion of body 912 and at least a portion of base 940.

As previously discussed, one aspect of the nozzle assemblies according to various embodiments of the present invention is that the onset of erosion of the protective layer can be readily determined by inspection of the stream of molten material or the flow rate of the molten material exiting the nozzle assembly. In contrast, the onset of erosion of typical ceramic nozzles cannot be readily determined. Further, as previously discussed, the powder made using a ceramic nozzle may have to be screened after production to eliminate the deleterious erosion debris, which is time consuming and can generate scrap. However, because the onset of erosion of the protective layer according to various embodiments of the present invention is readily detectable, the process can be interrupted and the nozzle replaced and only the affected material screened or scrapped.

Another non-limiting embodiment of a nozzle assembly for conveying a molten material according to the present invention comprises a body comprising a material having a melting temperature greater than the melting temperature of the molten material, the body including a first surface, a means for permitting flow of molten material through the body, and a means for preventing the dissolution of at least a portion of the body material due to contact with a flow of molten material. According to this non-limiting embodiment, the nozzle assembly can further comprise means for heating the nozzle assembly, wherein the means for heating the nozzle assembly is in communication at least a portion of the nozzle assembly. For example, although not limiting herein, the means for heating the nozzle assembly can be in communication with at least a portion of the body and at least a portion of the means for supporting the body. Alternatively, the means for heating the nozzle assembly can be in communication with the body alone or the means for supporting the body alone. Additionally, although not required, the nozzle assembly can further comprise a means for cooling at least a portion of the means for supporting the body.

Once specific non-limiting embodiment of the present invention provides an apparatus for conveying a molten material, the apparatus comprising a nozzle assembly and a means for heating the nozzle assembly in communication with the nozzle assembly. According to this non-limiting embodiment, the nozzle assembly can comprise a body formed from molybdenum or a molybdenum alloy, the body comprising a first surface, a second surface opposite the first surface, a sidewall extending between and connecting a periphery of the first surface and a periphery of the second surface, and a molten material passageway that permits the flow of molten material through the body, the molten material passageway comprising a interior surface that extends between and connects at least a portion of the first surface and at least a portion of the second surface; a protective layer adjacent at least a portion of the first surface of the body and at least a portion of the interior surface of the molten material passageway, the protective layer comprising aluminum oxide; and a split-base comprising a support surface, the support surface being adjacent the sidewall of the body, the split-base including a first component and a second component that together are adapted to receive the body. Further according to this non-limiting embodiment, the means for heating the nozzle assembly can be connected to the split-base.

Methods of manufacturing nozzle assemblies according to various non-limiting embodiments of the present invention will now be described. One non-limiting embodiment provides a method of manufacturing a nozzle assembly comprising providing a body comprising a material having a melting temperature greater than a melting temperature of the molten material to be conveyed, the body including a first surface including at least one opening therein, and a molten material passageway having an interior surface extending from the at least one opening of the first surface through the body. According to this non-limiting embodiment, providing the body can comprise, for example, forming the body from a material having a melting temperature greater than a melting temperature of the molten material to be conveyed. For example, although not limiting herein, the body can be formed by machining the material into the desired configuration, or the body can be formed in a net-shape or near-net-shape process. For example, the body can be formed using standard powder metallurgy processes, such as pressing and sintering, or casting.

Further, according to this non-limiting embodiment, after providing the body, a protective layer that is essentially non-reactive with the molten material to be conveyed by the nozzle assembly is formed on at least a portion of the first surface of the body and at least a portion of the interior surface of the molten material passageway of the body. For example, although not limiting herein, according to certain non-limiting embodiments of the present invention, the protective layer may be formed by depositing the material forming the protective layer, such as (but not limited to) an oxide, on at least a portion of the first surface of the body and on at least a portion of the interior surface of the molten material passageway. Examples of suitable methods of depositing the material forming the protective layer include, but are not limited to, plasma spraying, high velocity oxy-fuel spraying, chemical vapor deposition, and electron beam physical vapor deposition.

In other non-limiting embodiments, the protective layer can be formed by oxidizing the material from which the body is formed. For example, in one non-limiting embodiment wherein the protective layer comprises an oxide, the protective layer can be formed by oxidizing at least a portion of the first surface of the body and at least a portion of the interior surface of the molten material passageway. For example, the body can be exposed to an oxidizing atmosphere at an elevated temperature to form the protective layer. Alternatively, although not limiting herein, the body can be oxidized by chemical, thermal, or electrochemical treatments, such as, but not limited to, anodizing.

In other non-limiting embodiments wherein the nozzle assembly further comprises an intermediate layer interposed between the protective layer and the interior surface of the molten material passageway (as previously discussed with reference to FIG. 2), the intermediate layer may be formed on the body for example by plasma spraying, high velocity oxy-fuel spraying, chemical vapor deposition, and electron beam physical vapor deposition. Thereafter, the protective layer can be formed over the intermediate layer using the same or a different technique. Other suitable methods of forming intermediate layers include, without limitation, oxidizing, nitriding and carburizing the body material.

Figure 10:
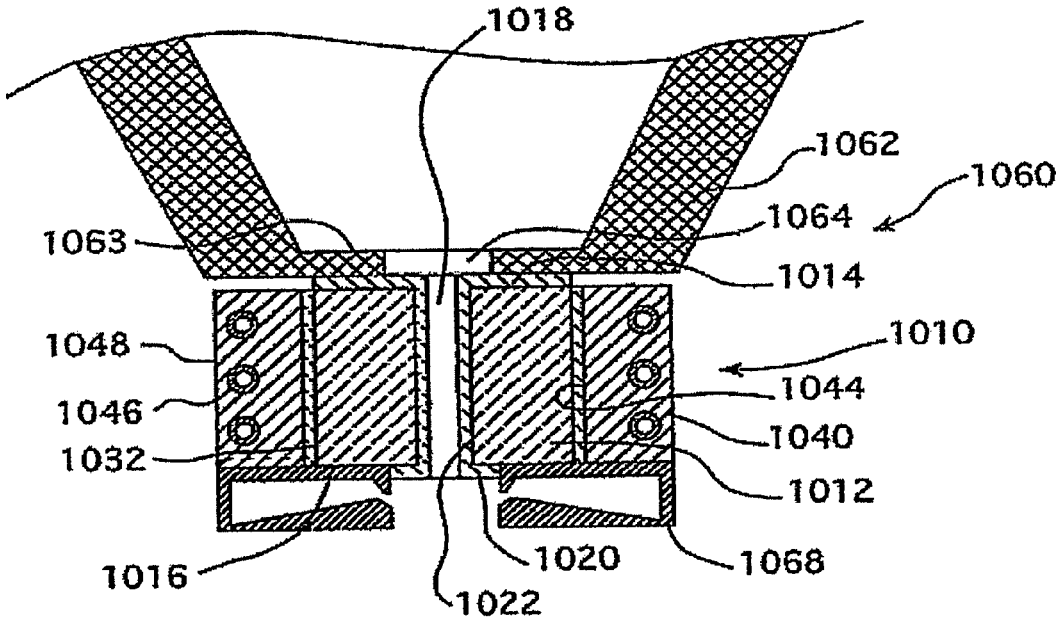
FIGS. 10 and 11 are schematic cross-sectional views of apparatus according to various non-limiting embodiments of the present invention.

Apparatus for atomizing molten material according to various embodiments disclosed herein will now be described. Referring now to FIG. 10, there is shown a schematic cross-sectional view of an apparatus for atomizing a molten material according to one non-limiting embodiment of the present invention. As shown in FIG. 10, the apparatus, generally indicated as 1060, comprises a vessel 1062 for holding the molten material. Vessel 1062 includes a bottom wall 1063 having an opening 1064, which permits molten material to flow from vessel 1062. A nozzle assembly (generally indicated as 1010) is adjacent bottom wall 1063 of vessel 1062 to receive molten material from opening 1064. The nozzle assembly comprises a body 1012 comprising a material having a melting temperature greater than the melting temperature of the molten material to be conveyed. As shown in FIG. 10, the body 1012 may include a first surface 1014, a second surface 1016 opposite first surface 1014, and a sidewall 1032 that extends between and connects the periphery of first surface 1014 and the periphery of second surface 1016. Further, body 1012 comprises a molten material passageway 1018 extending through body 1012 from the first surface 1014 to the second surface 1016 to permit the flow of molten material through body 1012. The molten material passageway 1018 comprises an interior surface 1022, and a protective layer 1020 is on at least a portion of first surface 1014 of body 1012 and on at least a portion of interior surface 1022 of the molten material passageway 1018. Protective layer 1020 comprises a material that is essentially non-reactive with the molten material. Further, as shown in FIG. 10, an atomizer 1068 is in communication with nozzle assembly 1010. Suitable atomizers that can be used in conjunction with this and other non-limiting embodiments disclosed herein are known in the art.

Although not required, as shown in FIG. 10, the apparatus for atomizing molten material 1060 can further comprise a base 1040, which is adapted to receive body 1012. Base 1040 includes a support surface 1044 and an external surface 1048 opposite support surface 1044, and may include a cooling channel 1046 as previously discussed with respect to FIG. 5. As shown in FIG. 10, base 1040 may be positioned such that the sidewall 1032 of body 1012 is adjacent support surface 1044 of base 1040.

Figure 11:
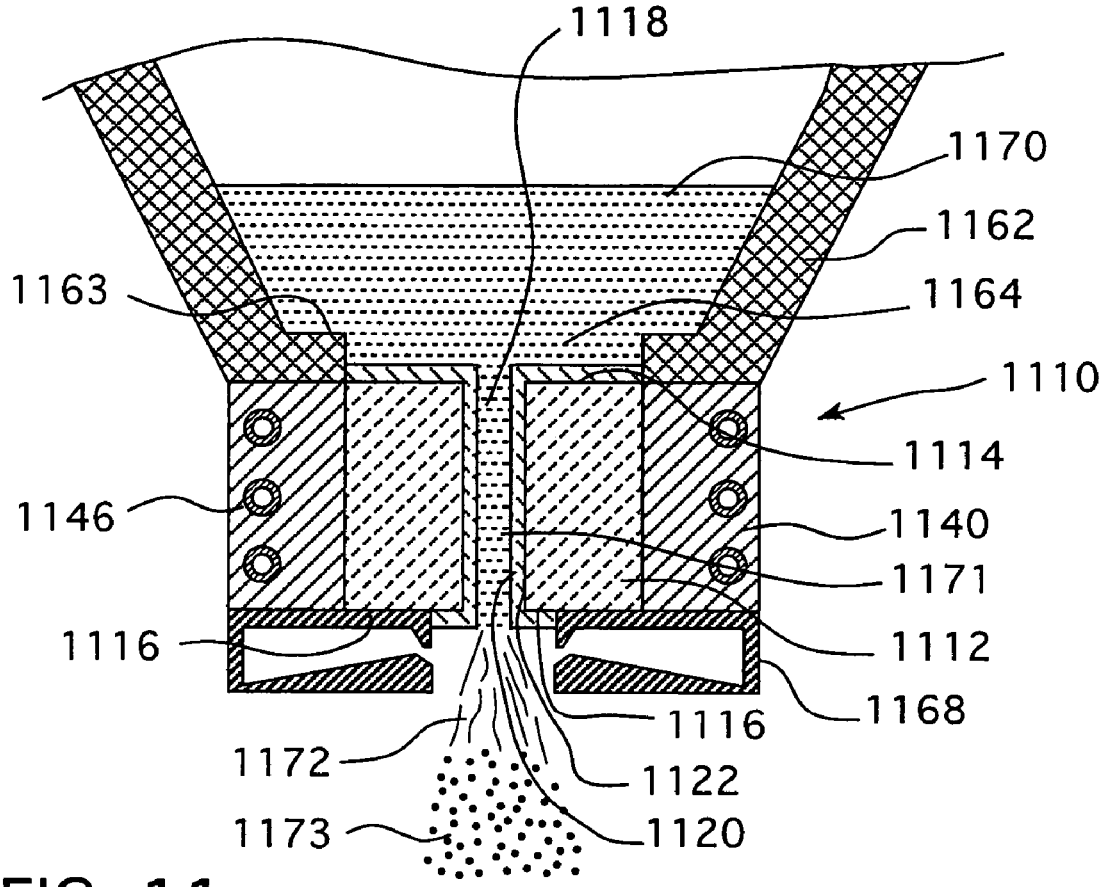

As shown in FIG. 10, according to various non-limiting embodiments disclosed herein, nozzle assembly 1010 can be positioned adjacent the bottom wall 1063 of vessel 1062. Alternatively, as shown in FIG. 11, nozzle assembly 1110 can be positioned within the opening 1164 of the bottom wall 1163 of vessel 1162. Further, although not required, a power source (not shown in FIG. 10) can be connected to nozzle assembly 1010 as previously described. Alternatively, an induction heating coil can be positioned around the perimeter of body 1012 of nozzle assembly 1010 to permit heating of body 1012 and/or the molten material being conveyed by nozzle assembly 1010.

Another non-limiting embodiment of the present invention provides an apparatus for atomizing molten material comprising a means for supplying a molten material, and a means for receiving the molten material from the supply means in fluid communication with the supply means. The means for receiving the molten material comprises a body comprising a material having a melting temperature greater than the melting temperature of the molten material, the body including a first surface, a means for permitting flow of molten material through the body, and a means for preventing the dissolution of at least a portion of the material having a melting temperature greater than the melting temperature of the molten material due to contact with the molten material. The apparatus for atomizing molten material also comprises a means for atomizing molten material in fluid communication with at least a portion of the means for receiving the molten material. Further, according to this non-limiting embodiment, the apparatus for atomizing molten material can further comprise a means for heating at least a portion of the means for receiving the molten material. The means for heating at least a portion of the means for receiving the molten material can be in communication with at least a portion of the body and at least a portion of the means for supporting the body. Alternatively, the means for heating the means for receiving the molten material can be in communication with the body alone or the means for supporting the body alone. Additionally, although not required, the nozzle assembly can further comprise a means for cooling at least a portion of the means for supporting the body.

As previously discussed, various embodiments of the present invention contemplate methods of conveying a molten material and methods of atomizing molten materials. Referring now to FIG. 11, one non-limiting embodiment of the present invention provides a method of conveying a molten material comprising providing a molten material 1170 in a vessel 1162 including a bottom wall 1163 having an opening 1164 therein to permit a flow of molten material 1170 from vessel 1162, and flowing at least a portion 1171 of the molten material 1170 from vessel 1162 through a nozzle assembly (generally indicated as 1110) positioned adjacent vessel 1162. According to this non-limiting embodiment, the nozzle assembly 1110 comprises a body 1112 comprising a material having a melting temperature greater than the melting temperature of the molten material being conveyed and a base 1140 adapted to receive body 1112. As discussed above with respect to FIG. 5, base 1140 can include at least one cooling channel 1146. As shown in FIG. 11, according to this non-limiting embodiment, body 1112 has a first surface 1114, a second surface 1116 opposite the first surface, and a molten material passageway 1118 extending through body 1112 from first surface 1114 to second surface 1116 to permit the flow of molten material through body 1112. The molten material passageway 1118 has an interior surface 1122 and a protective layer 1120 is adjacent at least a portion of the first surface 1114 and at least a portion of interior surface 1122 of the molten material passageway 1118. Further, although not required, as shown in FIG. 11, the protective layer 1120 can also be on at least a portion of second surface 1116.

With continued reference to FIG. 11, the method of conveying molten material according to this embodiment may further comprise heating at least a portion of body 1112 while at least a portion of molten material 1170 is flowed through the molten material passageway 1118. A power source (not shown in FIG. 11) can be connected to the nozzle assembly as previously discussed. Alternatively, an induction or resistance heating coil (not shown in FIG. 11) can positioned around the perimeter of the body to permit heating of the body.

It will be appreciated by those skilled in the art that the methods of conveying molten metal according to the embodiments of the present invention can be used in conjunction with atomization processes (as discussed below) or, alternatively, they can be used in conjunction with other processes, such as tapping a ladle containing molten material, casting ingots from molten materials, or continuous casting.

Another non-limiting embodiment disclosed herein provides a method of atomizing molten materials comprising providing a molten material in a vessel including an opening to permit a flow of the molten material from the vessel and flowing at least a portion of the molten material from the vessel through a nozzle assembly positioned adjacent vessel. According to this non-limiting embodiment, the nozzle assembly can comprise a body comprising a material having a melting temperature greater than the melting temperature of the material being conveyed. As previously discussed, the body may include a first surface, a second surface opposite the first surface, and a molten material passageway that permits the flow of molten material through the body. Further, a protective layer may be adjacent at least a portion of the first surface, at least a portion of the interior surface of the molten material passageway, and optionally adjacent a portion of the second surface.

Referring again to FIG. 11, on exiting nozzle assembly 1110 the molten material forms an exit stream 1172, which is atomized by impinging the exit stream 1172 with a fluid stream to break up the exit stream into molten droplets 1173, which cool to form powders as they fall into a collection zone (not shown in FIG. 11). For example, although not limiting herein, the molten material exit stream can be impinged with a liquid, air or an inert gas stream issuing from an atomizer 1168 positioned below the nozzle assembly 1110. With continued reference to FIG. 11, although not required, the method of atomizing molten material according to various non-limiting embodiments disclosed herein can further comprise heating at least a portion of body 1112 while the at least a portion 1171 of molten material 1170 is flowed through the molten material passageway 1118 of body 1112 of nozzle assembly 1110. As previously described, a power source (not shown in FIG. 11) can be connected to at least a portion of body 1112, at least a portion of the base 1140, or a power source can be connected to at least a portion of body 1112 and at least a portion of base 1140 to heat nozzle assembly 1110. Alternatively, an induction or resistance heating coil (not shown in FIG. 11) can be positioned around the perimeter of body 1112 to permit heating of body 1112 and/or the molten material being conveyed by nozzle assembly 1110.

As previously discussed, one advantage of nozzle assemblies according to certain non-limiting embodiments of the present invention is that the nozzle assembly is self-inspecting. For example, failure of at least a portion of the protective layer can cause a change in the flow rate of the molten material exit stream and/or the appearance of the exit stream. Accordingly, although not required, methods of atomizing molten material according to certain non-limiting embodiments of the present invention can further comprise inspecting the molten material exit stream to determine if the appearance and/or flow rate of the exit stream has occurred, and regulating the operating conditions in response to the inspection. For example, in response to the inspection, the process can be stopped if a significant change in appearance and/or flow rate of the exit stream is observed. Alternatively, if the inspection shows no significant change in the exit stream, the operation can be permitted to continue.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, those of ordinary skill in the art will, upon considering the foregoing description, recognize that many modifications and variations of the invention may be employed. All such variations and modifications of the invention are intended to be covered by the foregoing description and the following claims.

What is claimed is:

1. A nozzle assembly for conveying a molten material, the nozzle assembly comprising:

a body formed from a material having a melting temperature greater than a melting temperature of the molten material to be conveyed by the nozzle assembly, the body comprising a first surface, a second portion opposite the first surface, and a molten material passageway extending through the body from the first surface to the second portion to permit the flow of molten material through the body, the molten material passageway having an interior surface;

a base adapted to receive the body, the base comprising a support surface, wherein at least a portion of the support surface of the base is adjacent at least a portion of the body, wherein the base comprises a thermally conductive material, and wherein the base is a split-base comprising two or more components that together are adapted to receive the body, the two or more components each comprising a support surface, wherein at least a portion of each support surface of each split-base component is in direct contact with at least a portion of the sidewall of the body; and a protective layer at least one of directly deposited and indirectly deposited on at least a portion of the first surface of the body and at least a portion of the interior surface of the molten material passageway, the protective layer comprising a material that is essentially non-reactive with the molten material to be conveyed by the nozzle assembly.

2. The nozzle assembly of claim 1 wherein the material having a melting temperature greater than the melting temperature of the molten material to be conveyed by the nozzle assembly material is selected from the group consisting of titanium and titanium alloys, zirconium and zirconium alloys, hafnium and hafnium alloys, vanadium and vanadium alloys, niobium and niobium alloys, tantalum and tantalum alloys, chromium and chromium alloys, molybdenum and molybdenum alloys, tungsten and tungsten alloys, platinum and platinum alloys, graphite, molybdenum disilicide, silicon carbide, nickel aluminide, and combinations and mixtures thereof.

3. The nozzle assembly of claim 2 wherein the material having a melting temperature greater than the melting temperature of the molten material to be conveyed by the nozzle assembly is selected from the group consisting of molybdenum and molybdenum alloys, tungsten, and graphite.

4. The nozzle assembly of claim 1 wherein the second portion of the body is a surface or an edge.

5. The nozzle assembly of claim 1 wherein the protective layer comprises an oxide selected from the group consisting of aluminum oxide, zirconium oxide, magnesium oxide, calcium oxide, hafnium oxide, yttrium oxide, lanthanum oxide, and combinations and mixtures thereof.

6. The nozzle assembly of claim 1 wherein the protective layer has a thickness ranging from 0.001 millimeter to 0.5 millimeter.

7. The nozzle assembly of claim 1 wherein the second portion is a second surface and the body comprises a sidewall that extends between a periphery of the first surface and a periphery of the second surface, and wherein the support surface of the base is adjacent at least a portion of the sidewall of the body.

8. The nozzle assembly of claim 7 wherein at least a portion of the support surface of the base is in direct contact with at least a portion of the sidewall of the body.

9. The nozzle assembly of claim 7 wherein a layer is interposed between at least a portion of the sidewall of the body and at least a portion of the support surface of the base.

10. The nozzle assembly of claim 7 wherein the base comprises a single component that is adapted to receive the body.

11. The nozzle assembly of claim 7 wherein a power source is connected to at least one of the body of the nozzle assembly and the base of the nozzle assembly to heat the nozzle assembly.

12. The nozzle assembly of claim 7 wherein the base comprises at least one cooling channel.

13. The nozzle assembly of claim 1 further comprising an intermediate layer interposed between at least a portion of the protective layer and the interior surface of the molten material passageway.

14. The nozzle assembly of claim 13 wherein the intermediate layer comprises a material having a coefficient of thermal expansion between that of the protective layer and that of the body.

15. The nozzle assembly of claim 1 wherein the nozzle assembly is heated by one of direct or indirect resistance heating, or direct or indirect induction heating.

16. The nozzle assembly of claim 1 wherein the protective layer has a thickness ranging from 0.01 millimeter to 0.25 millimeter.

17. The nozzle assembly of claim 1 wherein the base is formed from a thermally conductive material.

18. A nozzle assembly for conveying a molten material, the nozzle assembly comprising:

a body comprising a first surface, a second portion opposite the first surface, and a molten material passageway extending through the body from the first surface to the second portion to permit the flow of molten material through the body, the molten material passageway having an interior surface;

a protective layer at least one of directly disposed and indirectly disposed on at least a portion of the first surface of the body and at least a portion of the interior surface of the molten material passageway, the protective layer having a thickness ranging from 0.001 millimeter to 0.5 millimeter; and a split-base comprising two or more components that together are adapted to receive the body, the two or more components each comprising a support surface, wherein at least a portion of each support surface of each split-base component is in direct contact with at least a portion of the sidewall of the body.

19. A nozzle assembly for conveying a molten material, the nozzle assembly comprising:

a body formed from a material having a melting temperature greater than a melting temperature of the molten material to be conveyed by the nozzle assembly, the body comprising a first surface, a second surface opposite the first surface, a sidewall extending between a periphery of the first surface and a periphery of the second surface, and a molten material passageway extending through the body from the first surface to the second surface to permit the flow of molten material through the body, the molten material passageway having an interior surface;

a base adapted to receive the body, the base comprising a split-base comprising two or more components that together are adapted to receive the body, the two or more components each comprising a support surface, wherein at least a portion of each support surface of each split-base component is in direct contact with at least a portion of the sidewall of the body, and wherein the base comprises a thermally conductive material; and a protective layer at least one of directly disposed and indirectly disposed on at least a portion of the first surface of the body and at least a portion of the interior surface of the molten material passageway, the protective layer having a thickness ranging from 0.001 millimeter to 1 millimeter and comprising a material that is essentially non-reactive with the molten material to be conveyed by the nozzle assembly.

20. The nozzle assembly of claim 19 wherein the body is formed from molybdenum or a molybdenum alloy, the protective layer comprises aluminum oxide, and the base is a split-base comprising a first component and a second component that together are adapted to receive the body, and wherein the nozzle assembly further comprising a means for heating the nozzle assembly in communication with at least a portion of the nozzle assembly.

21. The nozzle assembly of claim 19 wherein the base is formed from a thermally conductive material.

22. An apparatus for atomizing a molten material, the apparatus comprising:

a vessel for molten material, the vessel including a channel permitting a flow of the molten material from the vessel;

a nozzle assembly adjacent the vessel to receive the flow of the molten material from the channel of the vessel, the nozzle assembly comprising:

a body formed from a material having a melting temperature greater than a melting temperature of the molten material, the body comprising a first surface, a second portion opposite the first surface, and a molten material passageway extending through the body from the first surface to the second portion to permit the flow of molten material through the body, the molten material passageway having an interior surface;

a base adapted to receive the body, the base comprising a split-base comprising two or more components that together are adapted to receive the body, the two or more components each comprising a support surface, wherein at least a portion of each support surface of each split-base component is in direct contact with at least a portion of the sidewall of the body, and wherein the base comprises a thermally conductive material; and a protective layer deposited on at least a portion of the first surface of the body and on at least a portion of the interior surface of the molten material passageway, the protective layer comprising a material that is essentially non-reactive with the molten material to be conveyed by the nozzle assembly; and an atomizer in fluid communication with the nozzle assembly.

23. The apparatus of claim 22 wherein the base is formed from a thermally conductive material.

24. A nozzle assembly for conveying a molten material, the nozzle assembly comprising:

a body formed from a material having a melting temperature greater than a melting temperature of the molten material to be conveyed by the nozzle assembly, the body comprising a first surface, a second surface opposite the first surface, a sidewall that extends between a periphery of the first surface and a periphery of the second surface, and a molten material passageway including an interior surface and extending through the body from the first surface to the second surface to permit the flow of molten material through the body;

a protective layer at least one of directly deposited and indirectly deposited on at least a portion of the first surface of the body and at least a portion of the interior surface of the molten material passageway, the protective layer comprising a material that is essentially non-reactive with the molten material to be conveyed by the nozzle assembly; and a split-base comprising two or more components that together are adapted to receive the body, the two or more components each comprising a support surface, wherein at least a portion of each support surface of each split-base component is in direct contact with at least a portion of the sidewall of the body, and wherein the split-base comprises a thermally conductive material.

25. The nozzle assembly of claim 24 wherein the protective layer comprises an oxide selected from the group consisting of aluminum oxide, zirconium oxide, magnesium oxide, calcium oxide, hafnium oxide, yttrium oxide, lanthanum oxide, and combinations and mixtures thereof.

26. The nozzle assembly of claim 24 wherein the protective layer has a thickness ranging from 0.001 millimeter to 0.5 millimeter.

27. The nozzle assembly of claim 24 wherein a layer is interposed between at least a portion of the sidewall of the body and at least a portion of the support surface of the split-base.

28. The nozzle assembly of claim 24 wherein a power source is connected to at least one of the body of the nozzle assembly and the split-base of the nozzle assembly to heat the nozzle assembly.

29. The nozzle assembly of claim 24 wherein the split-base comprises at least one cooling channel.

30. The nozzle assembly of claim 24 further comprising an intermediate layer interposed between at least a portion of the protective layer and the interior surface of the molten material passageway.

31. The nozzle assembly of claim 30 wherein the intermediate layer comprises a material having a coefficient of thermal expansion between that of the protective layer and that of the body.

32. The nozzle assembly of claim 24 wherein the nozzle assembly is heated by one of direct resistance heating, indirect resistance heating, direct induction heating, and indirect induction heating.

33. The nozzle assembly of claim 24, wherein:

the body is formed from one of molybdenum and a molybdenum alloy; and the protective layer comprises aluminum oxide and has a thickness ranging from 0.001 millimeter to 0.5 millimeter.

34. The nozzle of claim 33, further comprising means for heating the nozzle assembly in communication with at least a portion of the nozzle assembly.

35. The nozzle assembly of claim 24 wherein the protective layer has a thickness ranging from 0.01 millimeter to 0.25 millimeter.

36. The nozzle assembly of claim 24 wherein the split-base is formed from a thermally conductive material.

* * * * *